United States Patent [19]

Gregory

[11] Patent Number: 4,509,442

[45] Date of Patent: Apr. 9, 1985

[54] ACOUSTICAL SHIELD ASSEMBLY FOR A SEWING MACHINE

[75] Inventor: Lee W. Gregory, Hickory, N.C.

[73] Assignee: Marvel Specialty Company, Hickory, N.C.

[21] Appl. No.: 494,778

[22] Filed: May 16, 1983

[51] Int. Cl.[3] ..... D05B 77/00

[52] U.S. Cl. ..... 112/261; 181/287

[58] Field of Search ..... 181/200, 205, 284, 294, 181/287; 112/261, 40; 51/268; 74/608; 83/440.2, 478, 546, 860; 144/251 R

[56] References Cited

U.S. PATENT DOCUMENTS

| | | | |
|---|---|---|---|
| 963,181 | 7/1910 | Rod et al. | 74/608 |
| 991,496 | 5/1911 | Frye | 112/261 |
| 2,165,142 | 7/1939 | Jeffreys | 74/608 |
| 3,630,159 | 12/1971 | Zilg . | |
| 3,638,594 | 2/1972 | Armstead, Jr. et al. . | |
| 3,661,104 | 5/1972 | Fletcher et al. . | |
| 3,713,509 | 1/1973 | Carroll . | |
| 3,773,140 | 11/1973 | Mahajan et al. . | |
| 3,782,495 | 1/1974 | Nassof | 181/284 |
| 3,812,802 | 5/1974 | Pierce . | |
| 3,930,558 | 1/1976 | Schnell et al. . | |
| 3,960,237 | 6/1976 | Sleeper | 181/200 |
| 4,074,725 | 2/1978 | Bader et al. . | |
| 4,095,540 | 6/1978 | Kaltenbach et al. . | |
| 4,101,084 | 7/1978 | Andre et al. | 181/200 |
| 4,110,876 | 9/1978 | Weiss et al. | 181/200 X |
| 4,120,376 | 10/1978 | Palmer | 181/284 X |
| 4,248,647 | 2/1981 | Herron et al. | 181/294 X |
| 4,290,332 | 9/1981 | Schoeffling, Jr. | 181/287 X |
| 4,315,473 | 2/1982 | Torre . | |

OTHER PUBLICATIONS

Hoover, R. M. et al, "Double Wall Noise Control Enclosure for an Impulsive Sound Source", *Noise Control*, vol. 7, No. 5, pp. 12–17.

*Primary Examiner*—Werner H. Schroeder
*Assistant Examiner*—Andrew M. Falik
*Attorney, Agent, or Firm*—King, Liles & Schickli

[57] ABSTRACT

An acoustical shield assembly for an industrial sewing machine includes a plurality of shield components readily movable from operating sound attenuating positions to open positions permitting easy access to a sewing machine. The assembly preferably includes front and face shields pivotally mounted in overlapping relationship. A lower side shield is positionable beneath a sewing plate of a sewing machine and movable to an overlapping relationship with the front shield. A tubular shield is pivotally mounted above and to the rear of the sewing plate. Acoustical material is mounted in top of the tubular shield to dissipate machine generated noise. The assembly may also include a rear shield for partially enclosing the rear and one side of the sewing machine. The rear shield preferably has a top face cooperating in spaced relationship with a top face of the front shield, but defining an opening for passage of thread and the dissipation of heat. Selective shield components have multilayer acoustical coverings on their internal surfaces to absorb the sound energy.

14 Claims, 8 Drawing Figures

Fig. 1
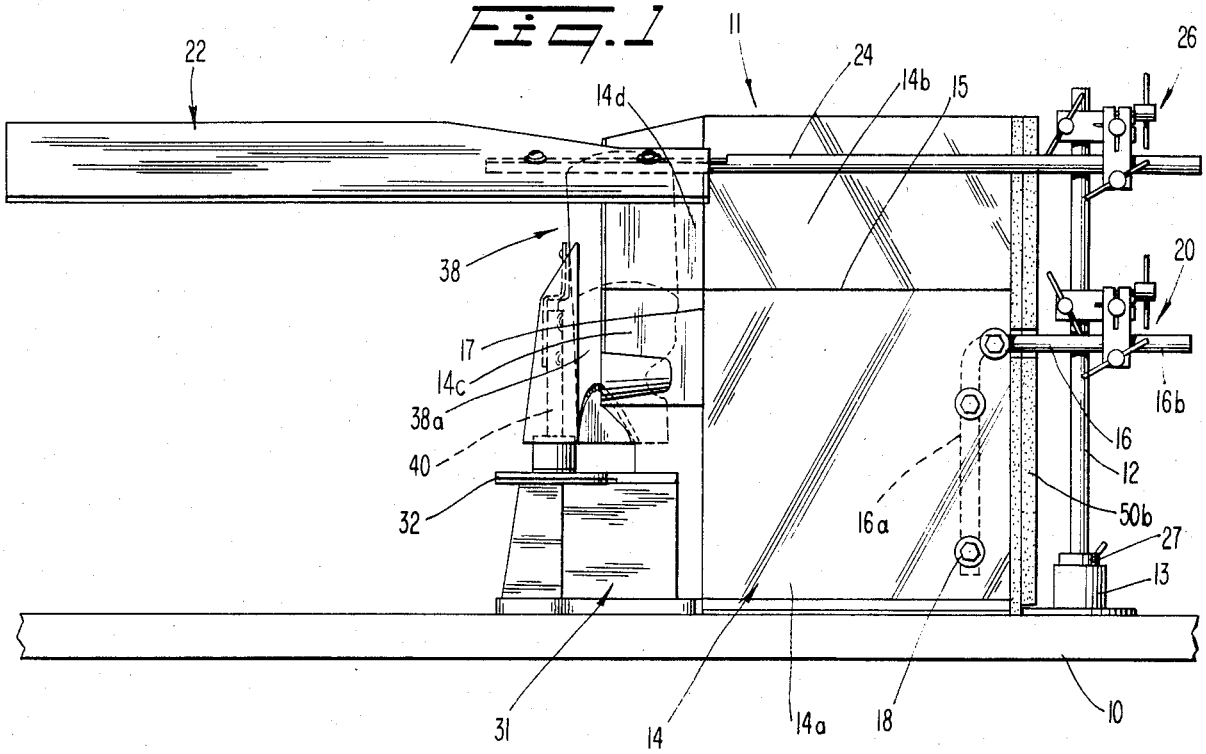
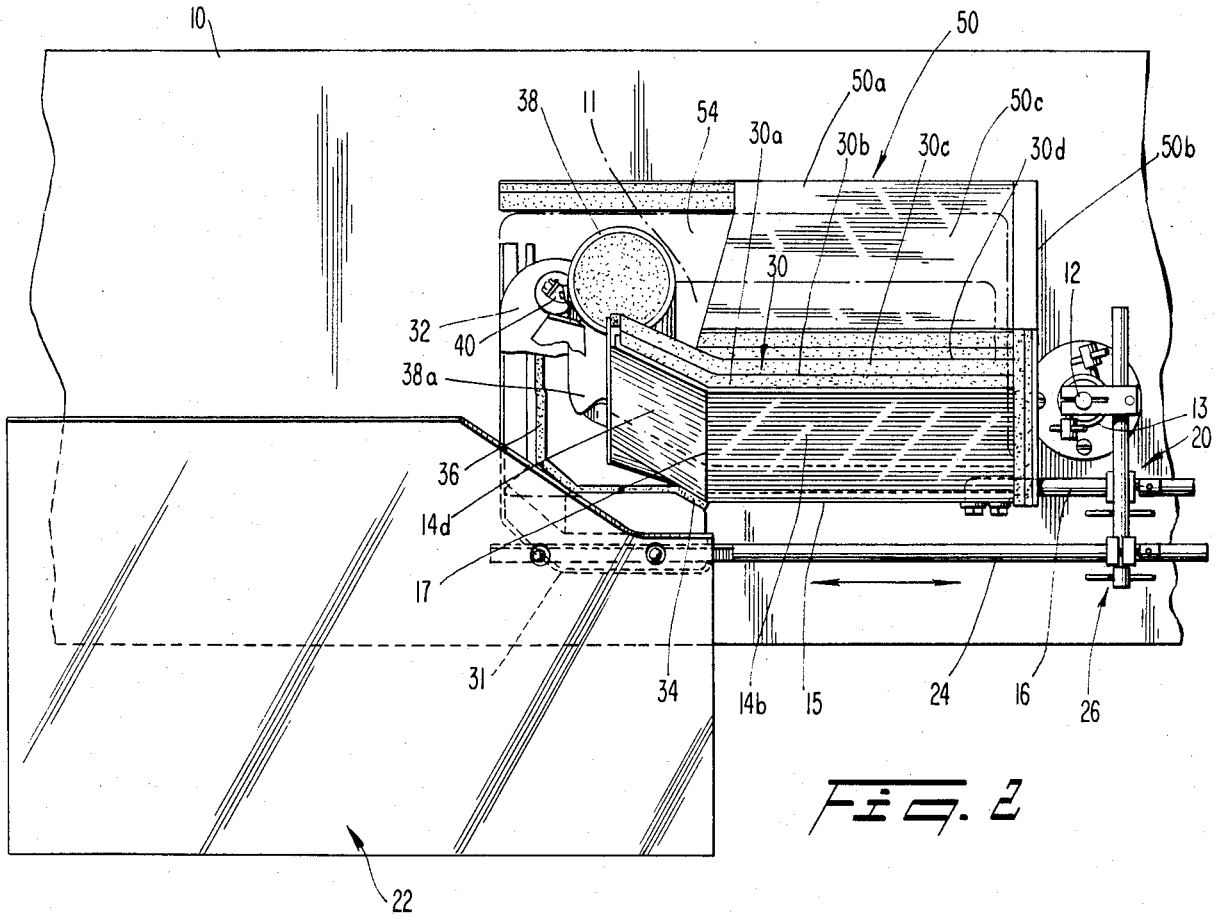
Fig. 2

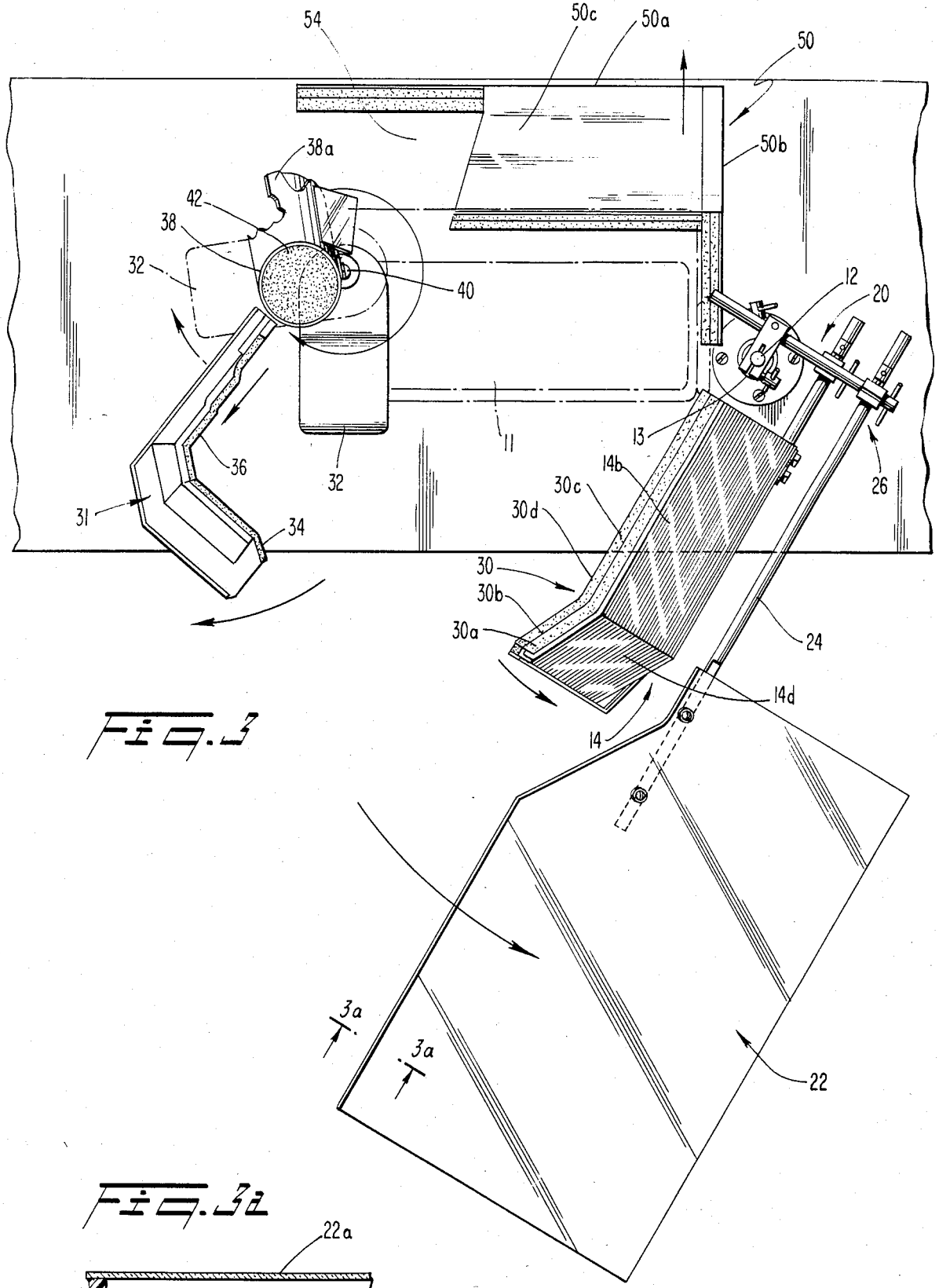
Fig. 3
Fig. 3a
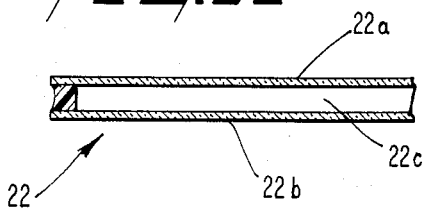

ACOUSTICAL SHIELD ASSEMBLY FOR A SEWING MACHINE

TECHNICAL FIELD

The present invention relates to sound attenuation in industrial machines and more particularly to an acoustical shield kit for protecting workers from machine generated noise. The invention has particular utility as a sound insulation structure for an industrial sewing machine.

BACKGROUND OF THE INVENTION

In recent years, considerable effort has been directed toward the protection of workers from the high noise levels generated by industrial machines. When high speed machinery such as sewing machines are involved, noise reduction activities have been focused in two major areas. The first area of activity is in the redesign and engineering of the machines themselves to eliminate the noise at its source. However, the inherent nature of high speed sewing machines and economics of redesign place limitations on the practical potential of sufficiently reducing sewing machine noise. Furthermore, many existing machines have undesirably high operating noise levels. Hence, considerable activity has also been focused upon the development of noise attenuation structures for insulating the noise from a worker.

Attenuation of machine generated noise is complicated by the cooling requirements of high speed sewing machines. In most present day industrial sewing machines, the machine generated heat is at least partially dissipated by natural convection. Noise attenuation structures for protecting workers against high noise levels could interfere with the natural convection heat transfer mechanism and result in machine overheating.

Furthermore, it is necessary for the operator of a sewing machine to have access to the working machine components on occasions. Access to the thread tract of the machine is particularly important. Noise attenuating structures also tend to interfere with such access and/or require cumbersome disassembly and reassembly.

In U.S. Pat. No. 3,638,594 to Armstead, Jr. et al, a shroud is mounted to a frame and held in fixed relationship to a sewing machine. A fan is used to rapidly pass air through a relatively thin channel between the shroud and the machine at a high velocity to achieve efficient cooling. However, the shroud of Armstead, Jr. et al does not surround a sewing head and does not significantly attenuate noise generated thereby. Further, this prior art shroud is not readily removable by the operator to provide quick and easy access to the covered machine components.

A noise attenuating kit for enclosing an industrial machine is disclosed in U.S. Pat. No. 3,773,140 to Mahajan et al. This attenuating structure includes a number of panels rigidly fastened to major frame members of the enclosed machine. Slidable panels provide access to selected areas of the machine and are sealed to adjacent panels to prevent the escape of noise when closed.

U.S. Pat. No. 4,074,725 to Bader et al discloses a multicomponent hinged cover for attenuating noise generated by selected components of a weaving machine. The cover is folded about its hinges to provide access to covered machine components when required.

SUMMARY OF THE INVENTION

Accordingly, it is a primary object of the present invention to provide an acoustical shield assembly for an industrial sewing machine or the like that permits significant noise reduction with strategically positioned shields.

It is a further object of the invention to provide an acoustical shield assembly for an industrial sewing machine or the like wherein the sewing machine is easily accessible by an operator and there is no thread interference.

It is another object of the invention to provide a sewing machine shield kit providing interfitting acoustical shields having coverings for dissipating noise and wherein selected combinations of the shields may be effectively used depending on the results desired or necessary.

Another object of the invention is to provide an acoustical shield assembly for reducing the noise of an industrial sewing machine to an acceptable level in accordance with OSHA standards without impairing the speed and operational efficiency of the machine operator.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved acoustical shield assembly is provided for attenuating noise generated by a sewing machine. The assembly comprises a number of strategically positioned shields interfitting together to give maximum noise reduction. A front shield is mounted to a vertical support post for pivotal movement toward and away from the front face of a sewing machine. The interior surface of the front shield has an acoustical covering for attenuating sewing machine generated noise. A face shield is mounted for pivotal movement along a parallel path to the front shield movement into overlapping relationship with the front shield when both shields are positioned in their operative sound attenuating positions.

The acoustical covering of the front shield preferably includes a continuous film overlying an acoustical foam lamination. Most preferably, the acoustical covering includes two layers of acoustical foam with an interposed elastomer. The continuous film, which is preferably aluminized polyester, is positioned adjacent to the sewing machine.

In a further aspect of the invention, the face shield is mounted on a vertical support post for concentric pivotal movement with the front shield. These shields may be moved separately or in unison to provide easy deployment to the operative position.

In another aspect of the invention, a lower side shield is positioned beneath the sewing plate of the sewing machine. This lower side shield is slidably movable into selective overlapping relationship with the front shield and captures and absorbs the noise at this location.

In a still further aspect of the invention, a tubular shield with acoustical material disposed in its top portion is pivotally mounted above the sewing plate and adapted for capturing and dissipating machine generated noise in the area of the needle and article feeding mechanism.

In a still further aspect of the invention, a noise attenuating kit for a sewing machine or the like is provided having relatively low cost shield components that interact in such a way to give exceptional performance in lowering the level of undesirable noise to a safe level for the operator and surrounding operators.

In a more specific aspect of the invention, a rear shield having an acoustical shield is provided to absorb noise that would otherwise be transmitted to an adjacent operator. Most preferably, both the front and rear shields have upwardly converging top panels to absorb noise. These two shields cooperatively form to leave a top opening for passage of the thread and the natural convection of machine generated heat.

In another aspect of the invention, an acoustical shield assembly or kit for attenuating sewing machine generated noise includes two key components, the front shield and the face shield. When used together, tests have shown an effective reduction in machine noise. In combination with the newer machines, such as the green Merrow seamer manufactured by The Merrow Machine Co. of Hartford, CN., this reduction is more than adequate to meet the current government requirements. When noise from surrounding machines is a problem or when older machines are being fitted for noise abatement, the additional shields disclosed as part of the invention bring the level to well within the requirements. The lower side shield adapted to be secured beneath the sewing plate and/or a rear shield with side extension are added next to give added noise attenuation. Finally, the tubular shield may be used in overlying relationship with the sewing plate. All of these additional shields have an acoustical covering on their interior side. The tubular shield actually has acoustical material rolled inside the tube and is secured to a shaft for easy pivotal movement toward and away from the machine with the sewing plate.

Still other objects of the present invention will become readily apparent to those skilled in this art from the following description wherein there is shown and described a preferred embodiment of this invention, simply by way of illustration of one of the best modes contemplated for carrying out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings:

FIG. 1 is a front elevational view of an acoustical shield assembly constructed according to the present invention depicting the shield elements in operative sound attenuating positions;

FIG. 2 is a plan view of the acoustical shield assembly of FIG. 1;

FIG. 3 is a plan view similar to FIG. 2 but showing the shield elements pivoted and/or moved to open positions to provide access to the sewing machine;

FIG. 3*a* is a partial cross sectional view along line 3*a*—3*a* of FIG. 3 showing the double pane version of the face shield;

Figure 4:
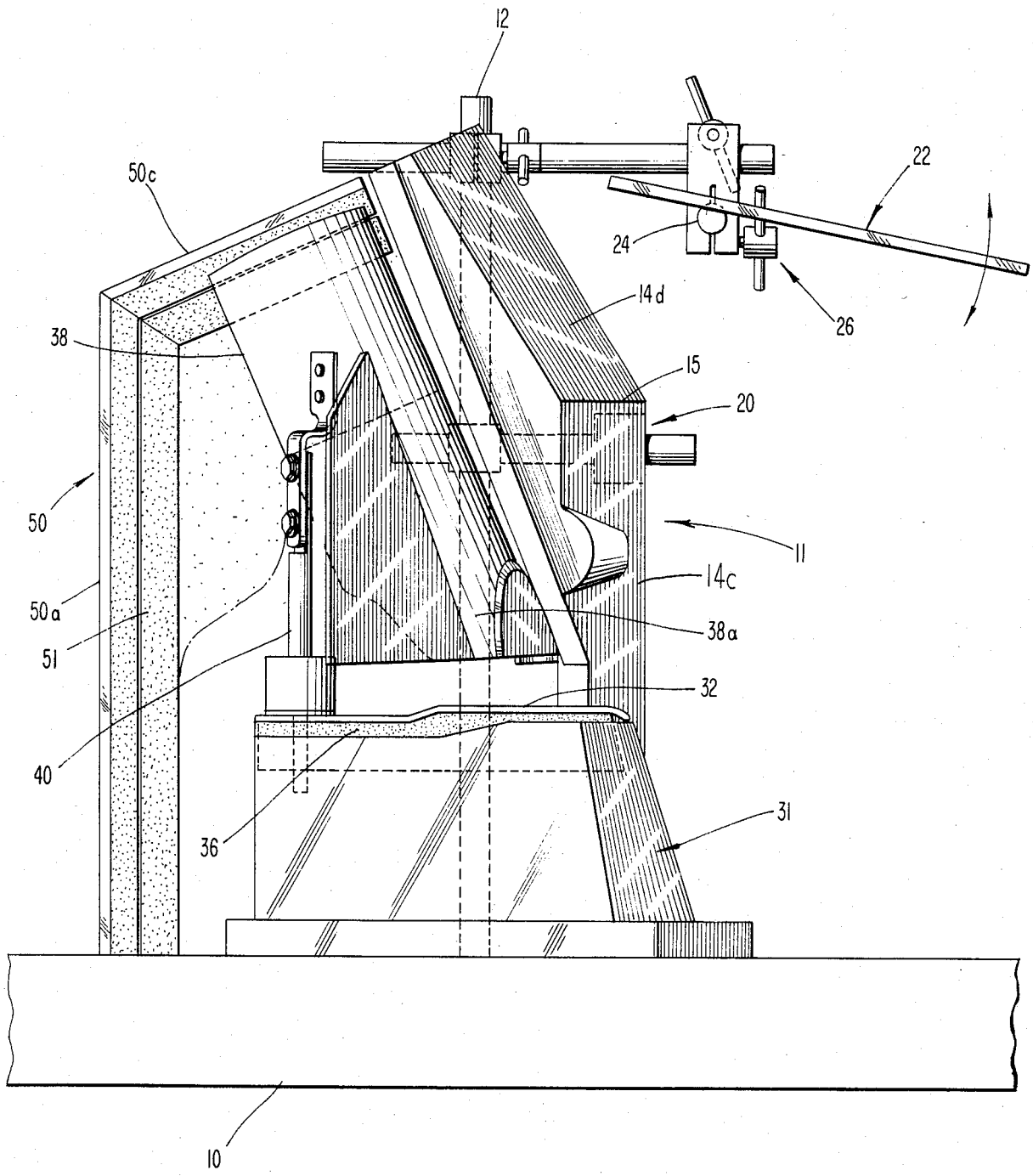
FIG. 4 is an enlarged side elevational view of the acoustical shield assembly of FIG. 1 depicting the lower side shield and the tubular shield.

Reference will now be made in detail to the present preferred embodiment of the invention, an example of which is illustrated in the accompanying drawings.

DETAILED DESCRIPTION OF THE PREFERRED EMBODIMENT

Reference is now made to FIG. 1 depicting an acoustical shield assembly in accordance with the present invention. The shield assembly is mounted on a base 10, which base 10 also supports a conventional industrial sewing machine 11 (shown in outline form only in FIG. 2 for example), such as a Merrow sewing machine for sewing the toes of socks.

The shield assembly includes a first columnar support post 12 vertically disposed on the base 10. The support post 12 is mounted for rotation about its longitudinal axis in a support collar 13 fixedly secured to the base 10. Bearings (not shown) are mounted in the support collar 13 to facilitate rotation of the support post 12 and to reduce friction between the collar 13 and the relatively rotating post 12.

An L-shaped rod extends outwardly (horizontally) from the post 12. One leg 16*a* of the L-shaped rod 16 is secured to an acoustical front shield 14 by a plurality of fasteners 18. The opposite leg 16*b* is supported on the post 12 by a clamping bracket 20. As most readily realized from a comparison of FIGS. 2 and 3, the post 12 is used to pivot the front shield 14 from a first strategic sound attenuating position (FIGS. 1 and 2) adjacent the sewing machine 11 to a second open position (FIG. 3) providing ready access to the sewing machine 11 by a machine operator (not shown).

The illustrated front shield 14 has four angularly joined sections 14*a*–*d* fabricated of suitable rigid plastic, such as PLEXIGLAS brand sheet glazing.

The fabricated shield is configured to partially enclose and conform to the outer profile of the sewing machine 11. A thin strip of energy absorbing foam, commercially available from E.A.R. Division, Cabot Corporation, Indianapolis, Ind. may be used to insure a proper acoustical seal between shield 14 and any necessary outer profile of sewing machine 11. This foam's density is high enough to dampen air-borne noise and its elasticity dampens vibration and closes all acoustical cracks. A substantially vertical section 14*a* is adapted for positioning in front of the sewing machine 11. A second front shield section 14*b* extends angularly upward from the top of section 14*a* toward the sewing machine 11 along an adjoining interface line 15. The vertical location of interface line 15 is coordinated with the height of the sewing machine 11 so as to partially extend the section 14*b* over the top of the sewing machine 11.

A third front shield section 14*c* extends from the side of section 14*a* with respect to the support post 12 along a substantially vertical interface line 17. The positioning of interface line 17 is coordinated with the end of the sewing machine 11 so as to partially wrap the section 14*c* around the head portion of the sewing machine 11 containing the sewing needle and presser foot mechanism (not shown). A fourth section 14*d* adjoins both sections 14*b* and 14*c* in angled-relationship to partially wrap around the side and top of the sewing machine 11.

As also shown in FIGS. 2 and 3, the interior surface of front shield 14 is covered with an acoustical sheet covering 30. The preferred covering 30 includes a first sound absorbing facing layer of urethane foam 30*a* adjacent the shield 14. A urethane elastomer vibration damper 30*b* is interposed between the first layer 30*a* and a surface decoupler layer 30*c* of the urethane foam material. The urethane foam absorbs sound and the elastomer 30*b* provides a mass for dampening the sound. A continuous aluminized polyester film 30*d* covers the surface decoupler layer 30*c;* the film 30*d* facing the noise source, while the decoupler 30*c* is suitably adhered to the interior surface of shield 14. The film 30*d* is bonded to the absorbing foam 30*a*. The multilayer acoustical covering 30 is commercially available under the trademark TUFCOTE from Specialty Composites Corporation of Newark, Del. and has been found to be highly effective in absorbing and damping the sound energy generated by the sewing machine 11. The elastomer damper 30*b* is highly effective in the lamination to convert the sound energy into mechanical vibration. The vibration dissipates the sound energy.

The support post 12 is also advantageously used in the preferred embodiment to support a face shield 22 in overlaying relationship to the front shield 14. The face shield 22 is secured to an elongated rod 24 by suitable fasteners and extends outwardly (horizontally) with respect to the support post 12. The elongated rod 24 is supported on support post 12 by a bracket 26. As shown most clearly in FIG. 4, the face shield 22 is disposed between the sewing machine 11 and an operator (not shown) in overlapping relationship to the front shield 14.

This shield is effective to reflect noise generated from the sewing machine 11 to further protect the operator's ears. Unlike the front shield 14, the face shield 22 of the preferred embodiment does not have the acoustical covering. A single sheet of plastic, such as PLEXIGLAS glazing, is highly effective in reducing the noise transmitted to the operator. However, the sound attenuating qualities of the face shield 22 may be enhanced by constructing the shield 22 of multiple panes separated by a gap of vacuum. Thus, any sound penetrating the first sheet is not as readily transmitted in the evacuated space. FIG. 3*a* shows the double pane construction wherein panes 22*a* and 22*b* are separated by gap 22*c*. If desired, the gap 22*c* may be simply an air gap, which is also effective in dissipating the energy, although not as effective as the vacuum in preventing transmission of the sound.

The shield 22 is positioned by adjustment with respect to the bracket 26 so as to be in the optimum position by protect the operator. The rod 24 may be adjusted longitudinally, as shown by the arrow in FIG. 2, so as to be directly between the operator and the noise.

In many cases, the shield 22 is shifted further to the right than shown in the drawing; the optimum position being generally selected to place the operator's head in the center of the shield with respect to the maximum noise level. Also, of course, the angle of the shield 22 may be adjusted (note arrow in FIG. 4) to further optimize the position.

The brackets 20 and 26 are also preferably adjustable to permit vertical adjustment along the support post 12. In the illustrated embodiment, each of the brackets 20, 26 include three adjustment handles, and the shields 14 and 22 are thus each adjustable in the three mutually perpendicular directions described.

A suitable spring detent arrangement 27 may be provided in the annular collar 13 (see FIG. 1). This device secures the support post 12 in the fixed angular position of FIG. 2 to position the front and face shields 14, 22 in operative sound attenuating positions. The detent may be overcome by manual force applied against the shields 14, 22 to quickly pivot the support post 12 and to move front and face shields 14, 22 to the open positions depicted in FIG. 3.

The acoustical assembly may optionally include a generally L-shaped lower side shield 31 for strategic disposition beneath a swingable sewing plate 32 (see FIGS. 3 and 4). The lower side shield 31 preferably has an angled edge 34 at the end of one leg, adapted for overlapping relationship with the front shield section 14*c* and for allowing sufficient interior space for scrap material to fall away from this area of the front face of sewing machine 11. two; May 13, 1983. This overlapping relationship is shown in FIG. 2. The other leg of the lower side shield 31 wraps around the side of sewing machine 11 and extends toward the rear of machine 11. In the preferred embodiment, a suitable foam sealing strip 36 is interposed between the lower side shield 31 and the swing plate 32 to block the escape of sound. If desired, this strip may be attached to the underneath side of the plate 32 instead of to the lower side shield 31. A multilayer acoustical covering, identical to the covering 30 of front shield 14 is construction, is attached to the internal surface.

The tubular shield 38 forming another part of the kit is positioned above the sewing plate 32 and the lower side shield 31. As clearly depicted in FIGS. 3–6, the tubular shield 38 is angularly mounted for pivotal movement on a shaft 40 with the movement of plate 32 (see arrow in FIG. 3). The shaft 40 extends through the sewing plate 32 and into the frame of the sewing machine 11.

Figures 5, 6, 7:
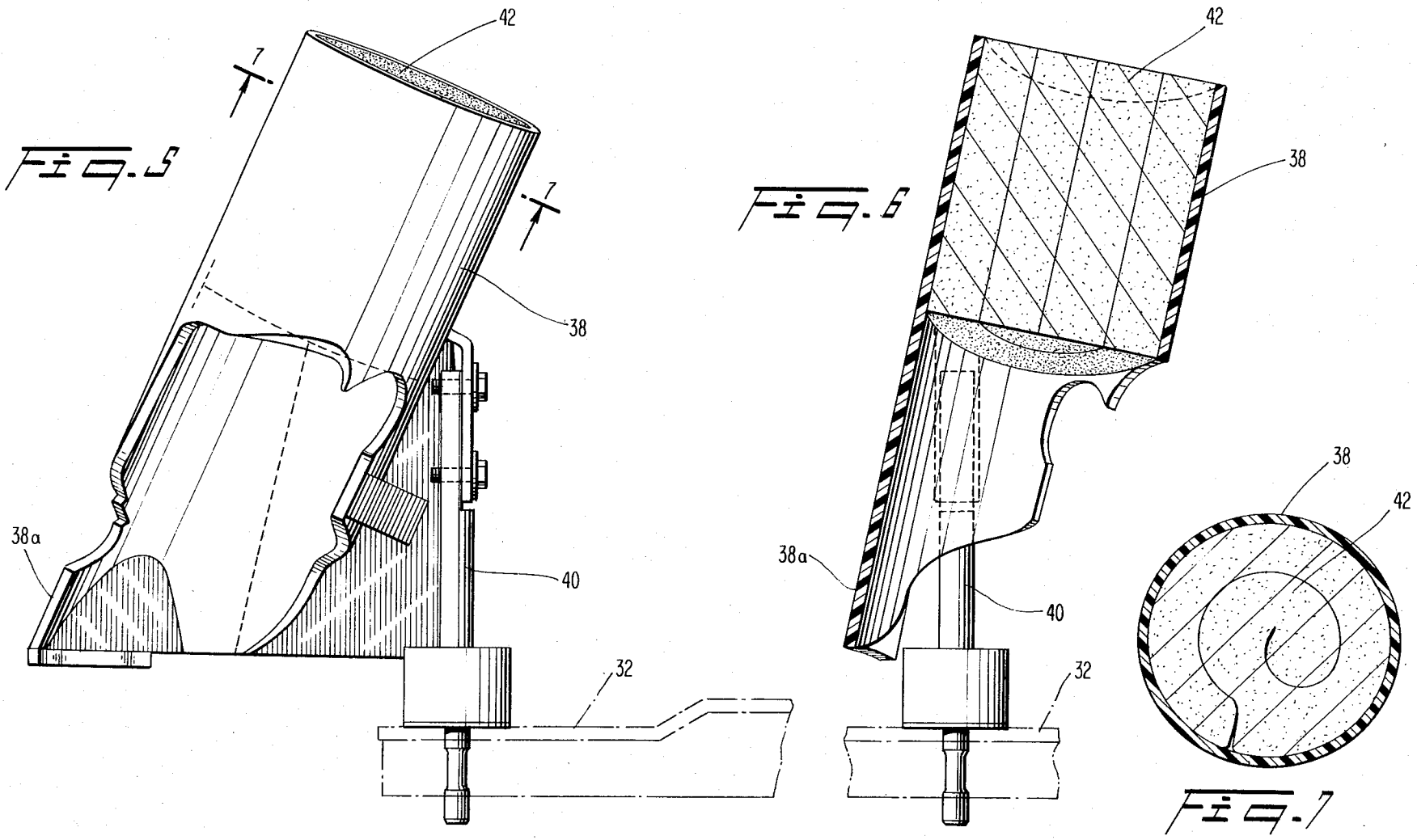
FIG. 5 is an enlarged side elevational view depicting the tubular shield and sewing plate of FIG. 4 in an open position to provide access to the sewing machine (looking in from left side of FIG. 3)
FIG. 6 is an enlarged cross sectional view of the tubular shield of FIG. 5.
FIG. 7 is a sectional view taken along plane 7—7 in FIG. 5 depicting acoustical material in the top portion of the tubular shield.

When moved to the operative sound attenuating position of FIGS. 2, 4 and 6, a downwardly depending skirt 38*a* of the tubular shield 38 is positioned over the sewing plate 32 to capture and absorb the noise of the driving mechanism for the sewing needle and presser foot of sewing machine 11. When so positioned, the tubular shield 38 captures and directs noise generated by the movement of these parts and other internal noises upwardly into the tubular shield in a "pipe-effect". A roll of acoustical material 42 (most clearly seen in FIGS. 6 and 7) is disposed in the top of the tubular shield 38 to absorb and dissipate the captured noise.

The sewing machine 11 may be further enclosed for extreme noise situations, such as with the older Merrow machines, by a rear shield component 50. The illustrated rear shield 50 includes substantially vertical rear and side sections 50*a* and 50*b* extending in perpendicular relationship to each other. As shown in FIG. 3, the section 50*b* extends along the side of sewing machine 11 adjacent the support post 12. The side section 50*b* has a notch (see FIGS. 1 & 2) to accommodate the rod 16 and to permit positioning of the side section 50*b* in close proximity to section 14*a* of the front shield 14. The rear shield 50 also has a top section 50*c* angled upwardly from the rear section 50*a*. The interior surface of the rear shield 50 has an acoustical covering 51 identical to the covering of front and lower side shields 14 and 31. Additionally, the top section 50*c* of rear shield 50 has an opening 54 for passage of thread to the sewing machine 11 and release of heat generated by machine by convection.

In summary, numerous benefits have been described which result from employing the concepts of the invention. The acoustical shield assembly 11 is effective to significantly reduce the level of noise generated by an industrial sewing machine to an acceptable level without significantly impairing the speed or efficiency of a sewing machine operator. In actual tests, the noise level of the older Merrow machine is reduced from approximately 97dBA (decibels on scale A, as perceived by the human ear) to 82dBA, well below the standard acceptable threshold limit of 85dBA. Using the assembly on quieter machines (the green Merrow machines), the level is readily reduced to 80dBA and below. The end result is the saving of the employees' hearing and a happier and more heathful environment in which to work. The employer of course also benefits from reduced lost job time and the attendant expenses of employee injury, thus making the hosiery mill more profitable.

In the preferred embodiment, the shield assembly should partially enclose a sewing machine and permit the escape of machine generated heat, such as through opening 54. The shields 14, 22, 31 and 50 are adjustable to obtain maximum attenuation and may be readily moved from an operative sound attenuating position to an open position (see arrows in FIG. 3) permitting easy access to the sewing machine. Certain of the shield components of the assembly have a multilayer laminate of acoustical covering for absorbing and converting the sound energy into mechanical energy.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, if desired a small fan may be positioned along the right-hand side to draw in fresh cooling air through the openings on the left side and other locations.A roof plate (not shown) above the opening 54 may be provided for additional noise attenuation with ceramic guides in the plate to guide the thread into the machine. Similarly, independent stand-up panels may be provided on base 10 at strategic locations to further reduce the sound.

The preferred embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention by defined by the claims appended hereto.

What is claimed is:

1. An acoustical shield assembly adapted for attenuating noise generated by a sewing machine or the like, comprising:

(a) a support post;

(b) a front shield mounted to the support post for movement relative to the support post to permit movement toward and away from the front face of the sewing machine;

(c) an acoustical covering on the interior of the front shield, said acoustical covering being closely spaced and substantially conforming to the front of the sewing machine so as to be operative for attenuating noise generated by the sewing machine; and (d) a face shield mounted for movement with respect to said support post, said face shield being transparent and adapted for selective positioning between the sewing machine and the adjacent face of the operator to allow observation of the sewing operation, said face shield being movable into overlapping relationship with said front shield when the front shield and the face shield are operatively positioned.

2. An acoustical shield assembly as recited in claim 1 wherein the acoustical covering includes a continuous thin film overlying an acoustical foam layer for dissipating sound energy.

3. An acoustical shield assembly as recited in claim 2 wherein the acoustical foam layer is urethane.

4. An acoustical shield assembly as recited in claim 2 wherein the countinuous film is aluminized polyester.

5. An acoustical shield assembly as recited in claim 2 wherein the acoustical covering includes two layers of acoustical foam with an interposed elastomer and a continuous film on the internal surface of the acoustical foam.

6. An acoustical shield assembly as recited in claim 1 wherein the front shield and the face shield are mounted for common pivotal movement on the support post.

7. An acoustical shield assembly as recited in claim 1 further including a means for holding the support post in a predetermined angular position.

8. An acoustical shield assembly as recited in claim 1 wherein said face shield includes a pair of plates with a space in between to further attenuate the noise.

9. An acoustical shield assembly as recited in claim 8 wherein said space is evacuated to hinder sound transmission.

10. An acoustical shield assembly adapted for attenuating noise generated by a sewing machine, comprising:

(a) a upstanding support post rotatable about its longitudinal axis;

(b) a front shield mounted to the support post for pivotal movement about the longitudinal axis of the support post toward and away from the front face of a sewing machine;

(c) an acoustical covering on the interior side of the front shield, said acoustical covering being adapted for attenuating noise generated by the sewing machine;

(d) a lower side shield movable into selective overlapping relationship with the front shield, said lower shield being adapted for securement beneath the sewing plate of a sewing machine;

(e) an acoustical covering on the interior side of the lower side shield adapted to attenuate noise generated by the sewing machine; and (f) a tubular shield secured to a shaft for pivotal movement toward and away from a sewing machine, the top portion of the tubular shield including acoustical material for dissipating noise.

11. An acoustical shield assembly adapted for attenuating noise generated by a sewing machine or the like, comprising:

(a) a support post;

(b) a front shield mounted to the support post for movement relative to the support post to permit movement toward and away from the front face of the sewing machine;

(c) an acoustical covering on the interior of the front shield, said acoustical covering being adapted for attenuating noise generated by the sewing machine; and (d) a face shield mounted for movement with respect to said support post, said face shield being adapted for selective positioning between the sewing machine and the face of the operator, said face shield being movable into overlapping relationship with said front shield when the front shield and the face shield are operatively positioned; and further including a lower side shield in selective overlapping relationship with the front shield, said lower side shield being adapted for positioning beneath the sewing plate of the sewing machine.

12. An acoustical shield assembly adapted for attenuating noise generated by a sewing machine or the like, comprising:

(a) a support post;

(b) a front shield mounted to the support post for movement relative to the support post to permit movement toward and away from the front face of the sewing machine;

(c) an acoustical covering on the interior of the front shield, said acoustical covering being adapted for attenuating noise generated by the sewing machine; and (d) a face shield mounted for movement with respect to said support post, said face shield being adapted for selective positioning between the sewing machine and the face of the operator, said face shield being movable into overlapping relationship with said front shield when the front shield and the face shield are operatively positioned; and further including a tubular shield secured to a pivotal shaft and acoustical material disposed in the top portion of the tubular shield for dissipating noise, said tubular shield being pivotally movable between operative and access positions over the sewing plate of the machine.

13. An acoustical shield assembly adapted for attenuating noise generated by a sewing machine or the like, comprising:

(a) a support post;

(b) a front shield mounted to the support post for movement relative to the support post to permit movement toward and away from the front face of the sewing machine;

(c) an acoustical covering on the interior of the front shield, said acoustical covering being adapted for attenuating noise generated by the sewing machine; and (d) a face shield mounted for movement with respect to said support post, said face shield being adapted for selective positioning between the sewing machine and the face of the operator, said face shield being movable into overlapping relationship with said front shield when the front shield and the face shield are operatively positioned; and further including a rear shield having an acoustical covering on an interior side, said rear shield having an integral side portion.

14. An acoustical shield assembly as recited in claim 13 wherein both the front and rear shields have substantially vertical plates with upwardly angular top plates, the top plates extending toward each other to trap the noise.

* * * * *